United States Patent [19]

Wiencke

[11] 4,445,738

[45] May 1, 1984

[54] LOCKING DEVICE FOR ELECTRICAL PLUGS

[76] Inventor: Erich K. Wiencke, 458 Kent Rd., Riverside, Ill. 60546

[21] Appl. No.: 426,670

[22] Filed: Sep. 29, 1982

Related U.S. Application Data

[63] Continuation-in-part of Ser. No. 283,949, Jul. 16, 1981, abandoned.

[51] Int. Cl.[3] ..... H01R 13/44

[52] U.S. Cl. ..... 339/37; 339/82

[58] Field of Search ..... 339/36, 37, 82, 94 R, 339/191 R, 191 A, 191 M

[56] References Cited

U.S. PATENT DOCUMENTS

| | | | |
|---|---|---|---|
| 2,654,073 | 9/1953 | Katz | 339/37 |
| 2,664,734 | 1/1954 | McEneaney | 339/37 |
| 2,733,416 | 1/1956 | Evalt | 339/37 |
| 3,195,100 | 7/1965 | Lee | 339/191 R |
| 3,601,761 | 8/1971 | Harris | 339/94 R |

*Primary Examiner*—John McQuade

*Attorney, Agent, or Firm*—Myers & Dvorak

[57] ABSTRACT

The locking device for an electrical plug comprises essentially a housing containing a lock mechanism, wherein the lock mechanism is a subassembly insertable into the housing. The lock mechanism comprises a lock body having a pair of spaced walls extending from a face wall which is provided with a centrally located aperture adapted to receive a manually operable key. The spaced walls provide a camming bed for rotatably supporting a cam member provided with an elongated cam slot. A pair of lock plates are provided with prong locking projections which are adapted to engage the openings in the prongs of the electrical plug, said locking projections also supporting said lock plates in opposed slots in the spaced walls. The opposite side of the cam member is provided with a key-engageable means which extends into an enlarged chamber between the spaced walls. The lock plates are also provided with transversely extending cam fingers which engage the cam slot. Securing means are provided for maintaining the lock mechanism in a predetermined position inside the housing. All of the components of the locking device are made from electrically non-conductive materials to preclude any possibility of a short circuit or body hazard to anyone tampering with the locking device. A shroud extends out of an end face of the housing to encircle the periphery of the abutting plug to discourage tampering. A modified form of a molded housing has an internal structure for supporting all of the movable locking components. A modified form of a lock mechanism comprises a unitary construction containing all of the locking components.

26 Claims, 13 Drawing Figures

LOCKING DEVICE FOR ELECTRICAL PLUGS

This is a continuation-in-part of U.S. patent application Ser. No. 283,949, filed July 16, 1981, now abandoned.

BACKGROUND OF THE INVENTION

1. Field of the Invention

This invention relates generally to a locking device, and particularly to locking devices which are adapted to cover the prongs of an electrical outlet to prevent the unauthorized use of an electrical apparatus or appliance associated with the electrical plug.

2. Description of the Prior Art

Electrical plug locking devices are generally known and have been invented to limit or control the use of certain apparatus and appliances, either because of danger associated with the use of certain apparatus or to limit the time of operations of appliances and apparatus.

A locking device for an electrical plug is shown in U.S. Pat. No. 2,664,734, wherein a locking housing contains an internal locking mechanism which is adapted to trap and lock the prongs of an electric plug inserted into the housing. Although this known device performs satisfactorily if undue force is applied to the electric plug, it can be wrenched out of the housing under certain occasions, and sometimes the internal locking mechanism can be forced out.

Another disadvantage of the known device is that the internal locking mechanism is made of metal parts which may present a hazardous condition to someone tampering with the locking device.

Another form of a known locking device for electric plugs is described in U.S. Pat. No. 2,654,073. This known device has a housing provided with a pair of slots for the insertion of the prongs of a plug, and has an internally-contained locking mechanism which is capable of locking only one of the prongs. Since one of the prongs is relatively loose, this encourages tampering by children, which may result in damage to the plug and the locking mechanism. The locking mechanism is complex because it uses a regular key and a barrel with a plurality of pins, and this would involve unusual expense in manufacturing.

SUMMARY OF THE INVENTION

A locking device for electric plugs incorporates a housing having a pair of openings which are adapted to receive prongs of the electrical plug. The end of the housing, adjacent the openings, is provided with a support block which acts as a bulwark for the locking mechanism disposed inside the housing. This arrangement prevents the locking mechanism from being forcefully withdrawn out of the housing. The locking mechanism comprises a lock body supporting a pair of lock plates resiliently forced away from each other so that locking projections on the lock plates will engage holes in the prongs of the electrical plug, and thereby lock the prongs to prevent withdrawal thereof. The locking projections are provided with slanted surfaces to facilitate the entry of the prongs into the housing and establish the locking of the electrical plug without the use of a key to complete the locking operation. An alternate form of a locking device comprises a unitary construction having locking projections resiliently supported on a bifurcated member and also supporting cam fingers for engagement with a cam member. The housing may be provided with an internal molded structure for supporting the movable locking components.

It is the main object of the invention to provide a locking device for an electrical plug, such device being simply constructed and economical to manufacture.

It is a further object of the invention to construct a locking device of components made from non-conducting materials so that electrical short-circuits and other hazardous conditions can be eliminated.

A still further object of the invention is to provide a locking device using a locking mechanism which is simple to construct and avoids maintenance problems.

Another object of the invention is to provide a locking device having a housing with a recessed face which is adapted to receive an abutting face of an electrical plug, the recessed face preventing tampering with the prongs of the plug by children.

A further object of the invention is to provide a locking mechanism having prong-locking projections integrally formed with a resilient support member.

A further object of the invention is to provide a locking device having an internal molded structure for supporting all of the movable locking components.

With the foregoing and other objects in view, the invention consists of a novel construction, combination and arrangement of various components which will be more specifically described and illustrated in the accompanying drawings.

It should be understood that various changes, variation, and modifications may be effected in the invention, but still will fall within the scope of the claims following the description.

DESCRIPTION OF THE PREFERRED EMBODIMENT

The preferred embodiment of the locking device for electrical plugs will now be described in reference to FIGS. 1–11.

Figure 3:
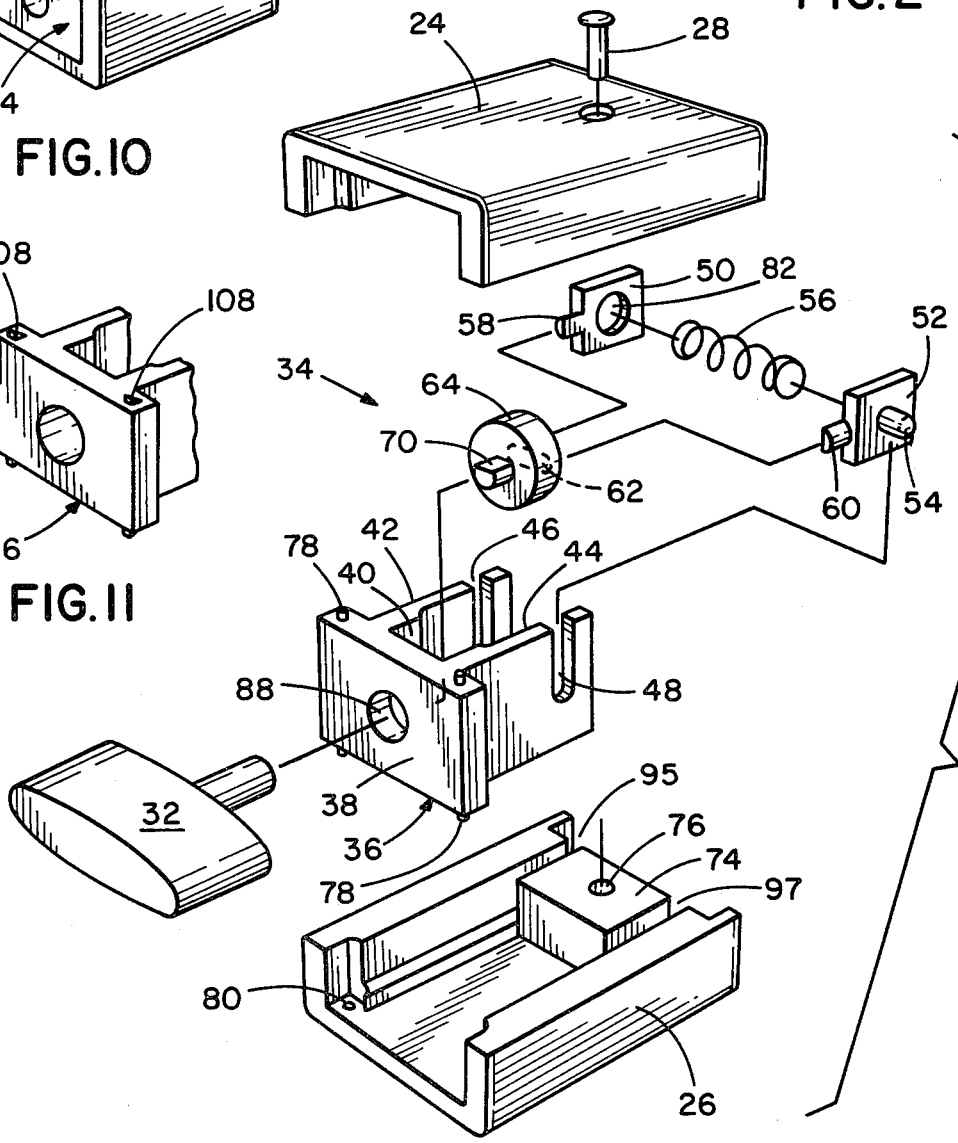
FIG. 3 is an exploded view of the locking device showing the various components of a locking mechanism.

Referring particularly to FIG. 3, a locking device 20 comprises a housing 22 having a pair of sections 24 and 26 held together by a securing member such as a rivet 28, preferably made from plastic material and heat sealed during the assembly of the locking device.

One end of the housing 22 is adapted to receive an electrical plug 30, and the other end of the housing is constructed to receive manually operable means in the form of a key 32 for the purpose of unlocking and releasing the plug 30.

Disposed in the interior of the housing 22 is a lock mechanism 34 comprising a lock body 36 having a frontal face 38 and an anterior face 40 from which extends a pair of spaced walls 42 and 44 provided with a pair of slots 46 and 48.

The slots 46 and 48 support a pair of lock plates 50 and 52 by means of locking members in the form of prong locking projections 54 which extend outwardly of the lock plates 50 and 52. The lock plates 50 and 52 are spaced apart from each other and resiliently urged away from each other by a spring 56. The lock plates 50 and 52 are provided with cam fingers 58 and 60 which engage with a cam slot 62 in a round cam member 64 which is rotatively supported on a camming bed 66 merging into the spaced walls 42 and 44, as best viewed in FIG. 6.

Figure 4:
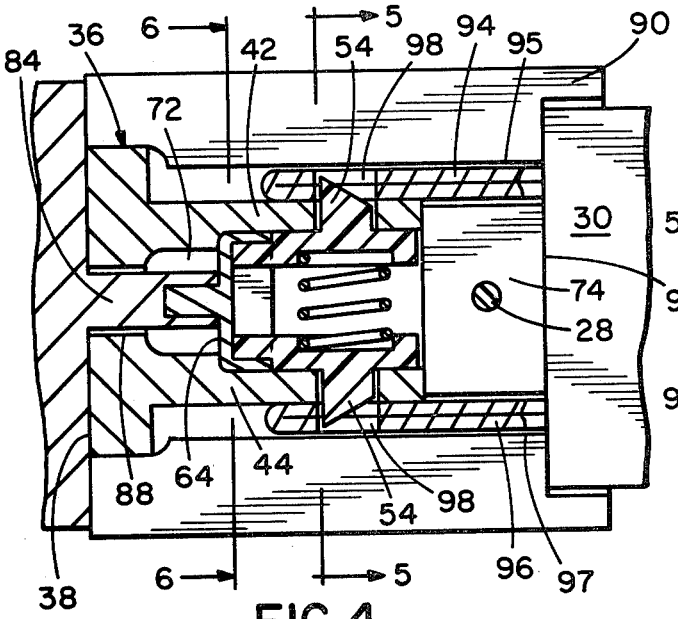
FIG. 4 is an enlarged sectional view along lines 4—4 of the device shown in FIG. 1, showing the locked positions of the plug prongs.
Figure 5:
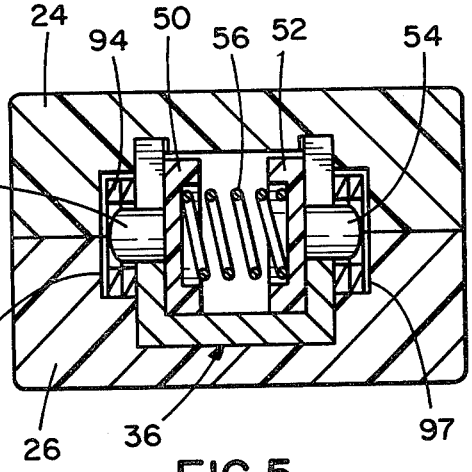
FIG. 5 is a sectional view taken along lines 5—5 in FIG. 4.

On one side of the cam member 64, opposite the side containing the cam slot 62, there is a projection 70 which is adapted to extend partly into a chamber 72 partly defined by the spaced walls 42 and 44 of the lock body 36 as shown in FIG. 4. Alternately, the projection 70 may be replaced by a depression in the face of the cam member 64, the depression being adapted to receive a complementary projection on the end of the key 32. One of the sections of the housing 22, such as section 26, is provided with a support block 74, which is integrally formed with the section 26. The support block 74 is provided with an opening 76 to accept the securing member 28 passing through the housing section 24. It is apparent that the use of the securing member 28 can be eliminated by electronically welding the sections 24 and 26 together.

The lock body 36 is provided with securing members such as pins 78 which are adapted to engage with complementary portions such as holes 80 located in the housing sections 24 and 26.

The lock mechanism 34 comprises a subassembly containing the lock body 36, cam member 64, the lock plates 50 and 52, and the spring 56.

Referring to FIG. 3, the lock mechanism 34 is assembled by placing the spring 56 between the lock plates 50 and 52, the ends of the spring 56 meeting with depressions 82 so that the spring would not pop out. The two lock plates 50 and 52 are brought together to compress the spring 56 until they barely touch each other so that the cam fingers 58 and 60 are in close proximity to each other for insertion into the cam slot 62 in the cam member 64. Thereafter, the lock plates 50 and 52, together with the engaged cam member 64, are inserted between the spaced walls 42 and 44 so that the prong locking projections 54 are received by the slots 46 and 48, and the cam member 64 is positioned in the camming bed 66, as best viewed in FIG. 6.

The lock body 36 is then inserted into the housing section 26 so that the pins 78 engage the holes 80. Thereafter, the section 24 is positioned over the section 76 and secured together by the securing member 28.

Figure 2:
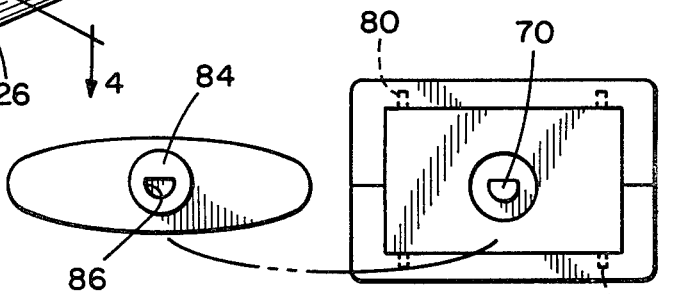
FIG. 2 is an end view of a key and an end view of a housing which is adapted to receive the key.

The key 32 has a shank 84 which, at its free end, has a keying aperture 86 which is adapted to engage the complementarily shaped projection 70 on the cam member 64, as shown in FIG. 2. The shank 84 extends through a key aperture 88 in the frontal face 38 of the lock body 36.

The sections 24 and 26 are provided with a lip 90 which is adapted to surround or enshroud an end face 92 of the plug 30, as particularly shown in FIG. 4.

Referring to FIGS. 3 and 4, it should be noted that the key aperture 88 in the frontal face 38 is smaller than the size of the chamber 72 between the walls 42 and 44. The purpose of the small key aperture 88 is to discourage tampering by inserting some tool, such as a screw driver, through the key aperture 88 and using the walls defining the chamber 72 to obtain a wedging action for the purpose of applying a torque to the projection 70 to rotate the cam member 64 to obtain the release of prongs 94 and 96 of the plug 30 from prong receiving apertures 95 and 97, respectively.

Reference will now be had to FIGS. 4–9 to indicate the different positions of the components forming the lock mechanism 34 in the locking and unlocking conditions of the locking device 20.

In FIG. 4, the plug 30 engages the locking device 20 in a locked condition because of the prongs 94 and 96 being engaged by the prong locking projections 54 which engage with holes 98 in the prongs 94 and 96. The end face 92 of the plug 30 abuts the support block 74 and is enshrouded by the lip 90 which denies access to the prongs 94 and 96 to someone who would attempt to attach conductors, such as wires, to the prongs 94 and 96 to utilize the electrical appliance or apparatus associated with the plug.

Figure 6:
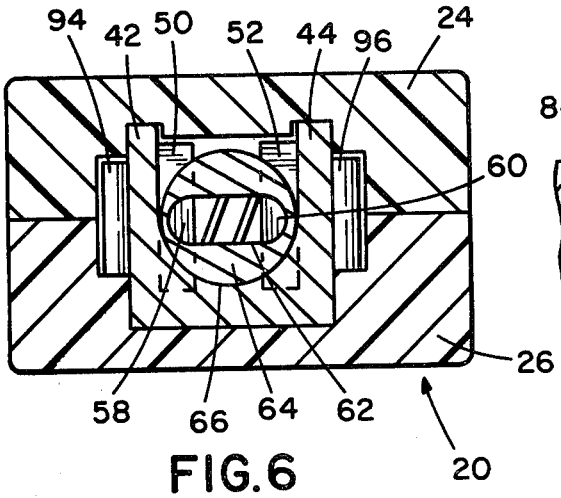
FIG. 6 is a sectional view taken along the lines 6—6 in FIG. 4, showing an elongated cam slot extending horizontally and indicating a locked position of the locking device.

FIG. 6 shows another sectional view through the locking device 20 which is in a locking condition. The cam slot 62 extends horizontally and permits the cam fingers 58 and 60 to be in their outermost positions so that the respectively associated prong locking projections 54, as shown in FIG. 4, lockingly engage the prongs 94 and 96.

Figure 7:
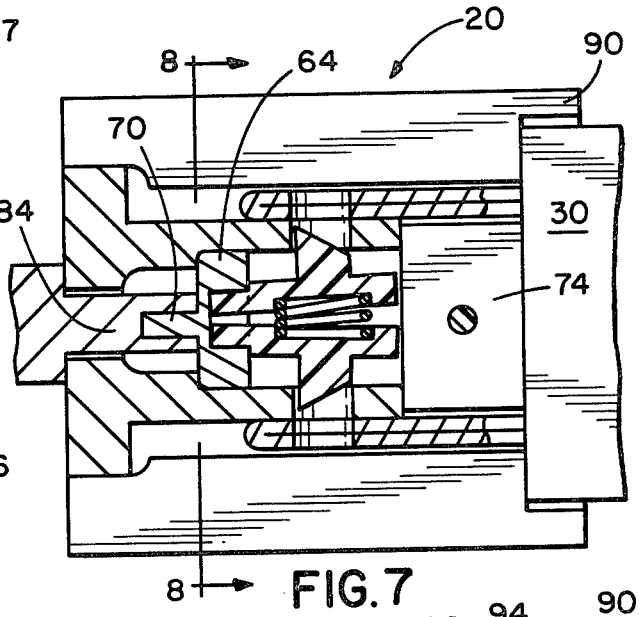
FIG. 7 is a sectional view similar to the sectional view shown in FIG. 4, except that the locking mechanism is shown in open position so that the prongs of the electrical plug can be withdrawn.
Figure 8:
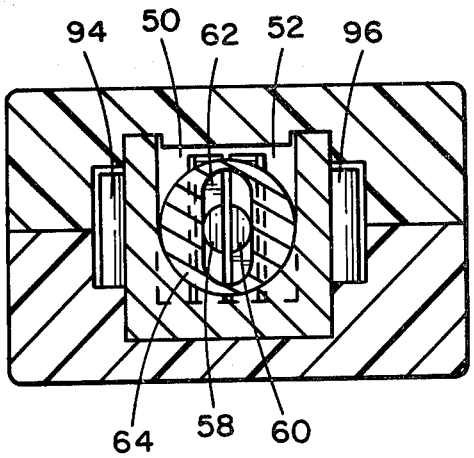
FIG. 8 is a sectional view similar to the sectional view shown in FIG. 6, except that the elongated cam slot is in a vertical position and responsible for withdrawing locking projections to release the prongs of the plug.

FIGS. 7 and 8 show sectional views through the locking device 20 when it is in an unlocking condition. When the key 32 and its associated shank 84 engaging the projection 70 on the cam member 64 is rotated one-quarter of a turn, the cam slot 62 assumes a vertically aligned position, as shown in FIG. 8, to thereby bring the lock plates 50 and 52 and their respective cam fingers 58 and 60 in close proximity to each other, thereby compressing the spring 56 and simultaneously withdrawing the prong locking projections 54 and 56 to thereby release the prongs 94 and 96 of the plug 30.

Figure 9:
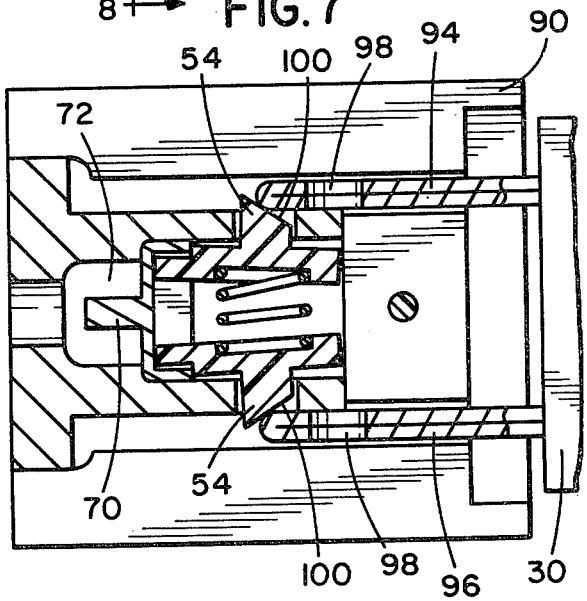
FIG. 9 is a sectional view of the locking device, wherein the locking projections have slanted surfaces to facilitate the engagement with the prongs of the plug as the prongs are pushed into the locking device.

The locking device 20 at all times is in a locking condition ready to receive the prongs of the plug without requiring the use of the key. Referring to FIG. 9, the prong locking projections 54 are provided with slanting surfaces 100 which facilitate the insertion of the prongs 94 and 96, the spring being slightly compressed as the prongs are inserted until a point is reached when the holes 98 in the prongs 94 and 96 are engaged lockingly by the prong locking projections 54 and 56.

Figure 10:
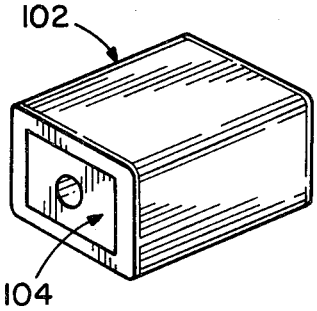
FIG. 10 shows a modified housing which has a one-piece molded construction.
Figure 11:
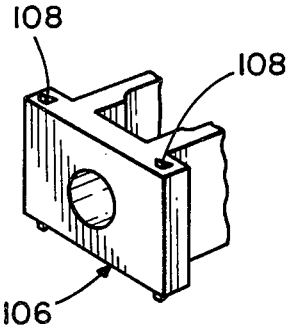
FIG. 11 shows a modified arrangement for securing the locking mechanism within the one-piece molded housing.

A modified form of the locking device 20 is shown in FIG. 10, wherein the housing 102 is made of a single molded construction and is adapted to receive through its one end a lock mechanism 104. The lock mechanism 104 is essentially the same as the lock mechanism 34, previously described, except that it possesses a lock body 106 which is provided with unidirectional securing members in the form of slanted projections 108 instead of pins 78 shown in FIG. 3. Since all of the components of the locking device 20 are formed from non-conductive materials, such as plastic, the lock body 106 can be forced into the opening of the housing 102, slightly forcing apart the opposed faces of the housing until the slanted projections 108 engage complementarily formed notches (not shown) molded in the undersurface of the opposed walls of the housing 102. Alternatively, the lock mechanism 104 may be secured inside the housing 102 by any other well-known means, for example, as by electronic welding.

This type of a modified construction of the housing enables the locking device to be manufactured at a lower cost as compared with the housing made up of two sections 24 and 26.

As shown in FIG. 2, the shank 84 of the key 32 has a keying aperture 86 which engages with a complementary projection 70. In the alternative, the projection and the aperture can be reversed so that the key and its shank 84 has a projection rather than an aperture, which projection will engage with a complementary aperture in the member 70. Although the aperture and the projection possess a half-moon shape, it is obvious that other forms of geometrically designed interlocking portions can be used to provide for proper engagement between the key and the projection 70 on the cam member 64.

Figure 12:
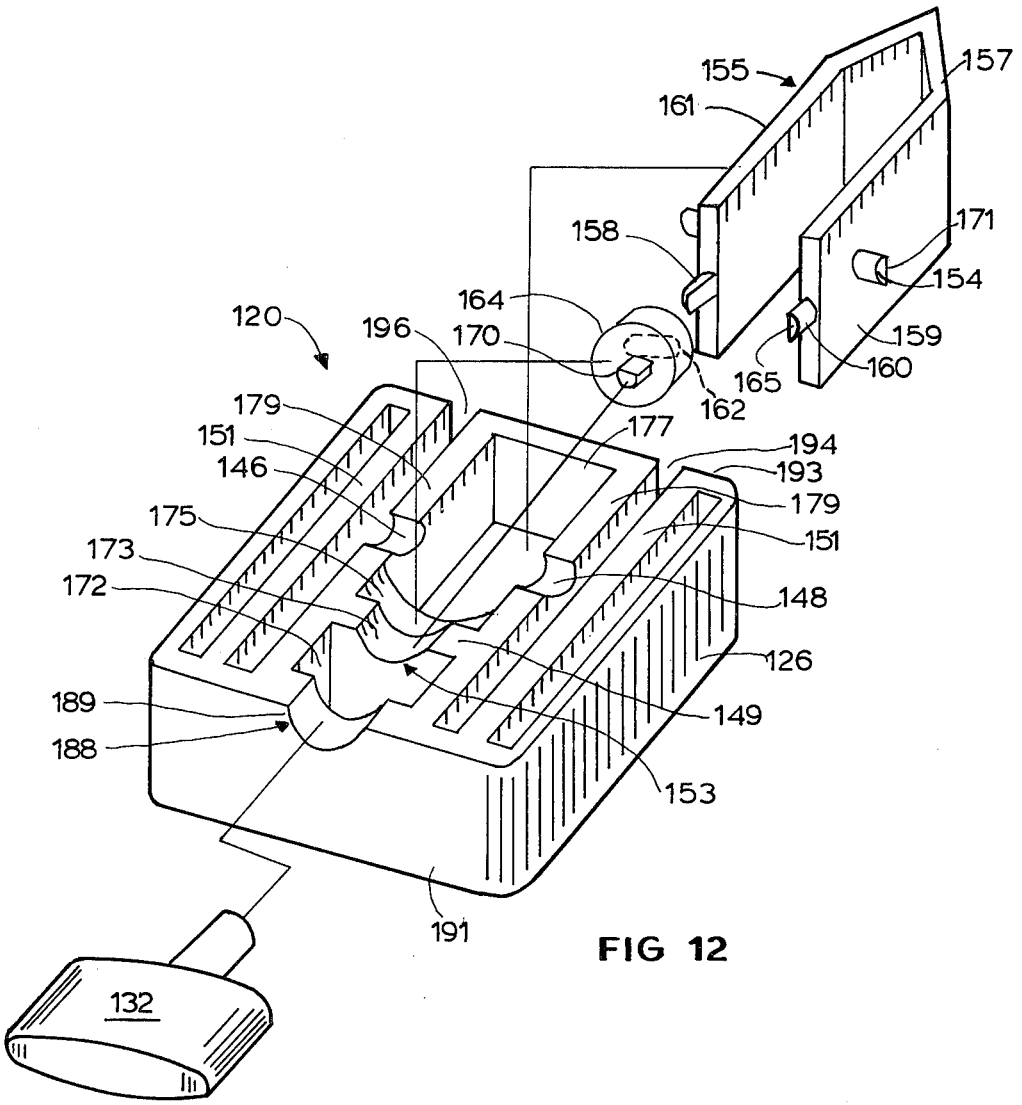
FIG. 12 is an exploded view of a modified locking device showing a modified construction of the locking mechanism.
Figure 13:
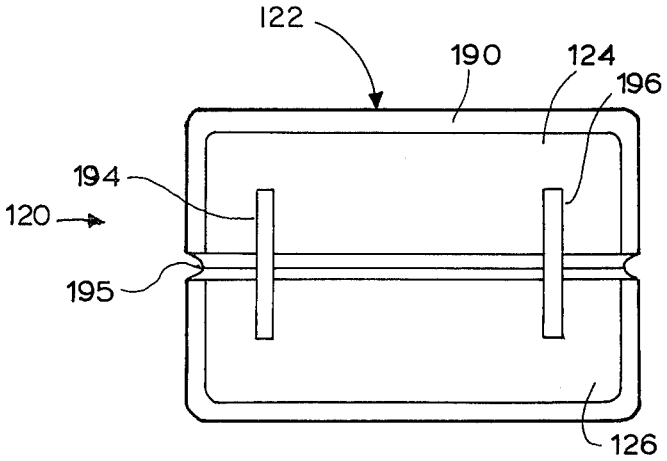
FIG. 13 is a rear view of the locking device showing the apertures for receiving the prongs of an electrical plug.

The locking device 20 previously described can be modified in certain ways to reduce the number of independent parts to thereby facilitate assembly thereof. For example, the lock body 36 can be molded integrally with the lock housing 22 and the lock plates 50, 52, and the spring 56 can comprise a single element. This modified embodiment is illustrated in FIGS. 12 and 13. The structural elements of this modified embodiment, which elements are similar to the structural elements in the preceding embodiment, will bear the same reference numerals except as increased by 100. The prong locking function of the modified embodiment shown in FIGS. 12 and 13 is the same as that described in respect to the first embodiment.

Figure 1:
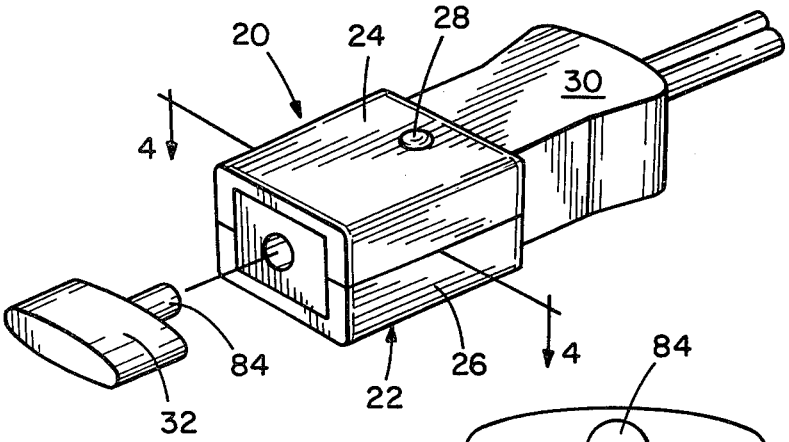
FIG. 1 is a perspective view of a locking device for an electrical plug, the locking device having a housing which attaches at one end of the plug, and at the other end has an arrangement for receiving a key for unlocking purposes.

A locking device 120 comprises a housing 122 having a pair of sections 124 and 126 which are adapted to be secured together by appropriate means, such as cement, so as to define in a rear wall 193, a pair of prong receiving apertures 194 and 196 adapted to receive the prongs of the electrical plug 30 shown in FIG. 1. The abutting faces of the sections 124 and 126 define a parting line 195 having a convex configuration to present a pleasing appearance. Since the internal molded structure of the sections 124 and 126 is similar, the internal structure of only section 126 is presented in FIG. 12, wherein a front wall 191 has a semi-circular portion 189 which, with a similar semi-circular portion 189 in the section 124, will define a key aperture 188 for receiving a key 132.

Proceeding rearwardly from the key aperture 188, the section 126 has a chamber 172, a semi-circular portion 173, a slotted bed or cam slot 175, and a large chamber 177. The large chamber 177 has a pair of spaced-apart walls 179 which have a pair of semi-circular slots 146 and 148. The cam slot 175 subtends from the walls 179. The semi-circular portions 173 subtend between extensions 149 integrally formed with the walls 179. The prong-receiving apertures 194 and 196 are defined by the walls 179 and internal walls 151 which extend parallel with the walls 179.

When the two sections 124 and 126 are abutted, the semi-circular portions 173 define an opening 153.

A prong locking mechanism 155 comprises a bifurcated member 157 having spaced wall elements 159 and 161 supporting a pair of outwardly directed projections 154 for translational movement along a transverse axis of the prong locking mechanism 155 and additionally supporting a pair of cam fingers 158 and 160 extending along a longitudinal axis of the prong locking mechanism 155.

It should be noted that the prong locking mechanism 155 is molded from a resilient material such as plastic so that the spaced wall elements 159 and 161 can approach each other when pressed together.

As shown, the cam fingers 158 and 160 are provided with flat sides 165 so that, when the spaced wall elements 159 and 161 are squeezed together, the flat sides will abut each other and the two cam fingers 158 and 160 will define a composite round element. The cam fingers 158 and 160 are adapted to be inserted into a cam slot 162 in a cam member 164 which is provided with engageable means such as a projection 170 to be engaged with an opening (not shown) in the key 132 for the rotative movement of the cam member 164 which will apply compressive forces to the cam fingers 158 and 160 as determined by the width of the cam slot 162.

The prong locking projections 154 integrally formed with the spaced wall elements 159 and 161 are adapted to be seated in the slots 146 and 148, the length of the prong locking projections 154 being such that they extend into the prong receiving apertures 194 and 196. To facilitate the insertion of the prongs of the plug 30 into the locking device 120, the prong locking projections 154 are provided with bevel surfaces 171. As the plug 30 is inserted into the locking device 120, the prongs of the plug will force the prong locking projections 154 inwardly, causing the wall elements 159, 161 to approach each other. As soon as the prong locking projections 154 encounter the conventional aperture in the plug prongs, the projections 154 snap outwardly, as was previously described in reference to the first embodiment.

The projection 170 on the cam member 164 is centrally confined within the opening 153.

The spaced apart position of the wall elements 159 and 161 indicates a closed condition of the locking device, wherein the prong locking projections 154 extend into the prong-receiving apertures 194 and 196. In order to release the electrical plug 30 from such locked condition, the key 132 would be inserted into the key aperture 188 to engage the projection 170 and apply a rotational force to the cam member 164 so that its cam slot 162 assumes a vertical position. During the rotational movement of the cam member 164, the cam slot 162 is effective to bring together the cam fingers 158 and 160 thereby causing the prong locking projections 154 to retreat into the slots 146 and 148, thereby releasing the prongs of the plug 30.

This invention, as described, should not be restricted to the precise details of construction shown, since various changes and modifications may be made therein without departing from the scope of the invention or sacrificing the advantages to be derived from its use.

What is claimed is:

1. A locking device for use with an electrical plug having two or more prongs, comprising a housing, a lock mechanism disposed within said housing, means for securing said lock mechanism in said housing, locking members movable translationally from an unlocking position to a locking position to lockingly engage at least two of said prongs when said plug is inserted into the housing camming means translationally coupling said locking members together, spring means for normally biasing said locking members into said locking position, manually operable means engageable with said camming means for moving said locking members to said unlocking position to obtain the release of said inserted plug.

2. The device according to claim 1, wherein said housing is provided at one end with two or more apertures adapted to accept said two or more prongs, and the other end is provided with an opening adapted to receive said manually operable means, said one end of said housing being provided with means to partially enshroud said plug, whereby the portion of the prongs emerging from said plug is concealed to prevent tampering.

3. The device according to claim 1, wherein said lock mechanism includes a lock body insertable into said housing, and said securing means comprises two portions, one portion being in the form of members extending out of said lock body at one end thereof and engaging said housing, said other portion being in the form of a support block integrally formed with said housing and abutting the other end of the lock body.

4. The device according to claim 1, wherein said lock mechanism in said housing comprises a lock body housing defining a pair of spaced walls joined by a face wall and defining a slotted bed and a pair of opposed elongated slots, an aperture in said face wall for receiving said manually operable means, said camming means being provided with an internal camming slot and rotatably supported in said slotted bed, a pair of lock plates disposed between said spaced walls, said lock plates having a pair of cam fingers engaging said internal camming slot and having a structure defining said locking members, said locking members insertably supporting said lock plates in said elongated slots, said spring means being a spring interposed between said lock plates to urge them and their associated locking members into the locking position, whereby said lock mechanism, when assembled, defines a subassembly which is insertable into said housing.

5. The device according to claim 4, said housing comprising an integrally molded structure having one end provided with two or more apertures for accepting the prongs of said plug and the other end having an entrance communicating with the interior of the housing, said lock mechanism having unidirectional securing members adapted to engage with said housing to secure said lock mechanism in the housing, whereby said subassembly is forcefully introduced through said entrance into the housing, said unidirectional securing members facilitating the entry of the subassembly into said housing but preventing the withdrawal of said subassembly from said housing.

6. The device according to claim 5, wherein the interior of said housing, at said one end of the housing, adjacent said prong apertures, is provided with an integrally molded support block forming a part of said securing means, and said unidirectional securing members forming the other part of said securing means.

7. The device according to claim 4, said camming means being operatively supported by said lock body housing and being provided with an engageable member disposed opposite to said internal camming slot, said manually operable means being in the form of a key having a free end adapted to engage said engageable member so that torque can be applied to rotate said camming means to apply a force to overcome the bias of said spring to thereby release said plug prongs.

8. The device according to claim 7, wherein said lock body housing is provided with an enlarged chamber adjoining said slotted bed, said chamber receiving said engageable member, said chamber being substantially larger than said aperture in the face wall, whereby the constricted size of the face wall aperture and the large chamber discourage tampering with the locking device.

9. The device according to claim 1, wherein said housing and said lock mechanism is made from electrically non-conductive materials.

10. The device according to claim 6, wherein said support block defines a portion of prong slots communicating with said two or more apertures.

11. In a locking device for use with an electrical plug having at least two prongs, including a housing, a lock mechanism disposed within said housing and adapted to lock the prongs when they are inserted into the housing, and manually operable means for unlocking said lock mechanism to release the prongs, the improvement wherein said lock mechanism comprises a lock body having a frontal face, a pair of spaced walls integrally formed with said frontal face and defining a chamber, an aperture in said frontal face for receiving said manually operable means into said chamber, the free ends of said walls being provided with a pair of spaced elongated slots, a pair of lock plates, each provided with a prong locking projection which supports said lock plate in a respective slot, a cam finger extending transversely from each of said lock plates, a biasing member disposed between said lock plates and maintaining said lock plates in the respective slots, and a cam member rotatively disposed in said chamber and engaging said cam fingers, and means on said cam member for cooperatively engaging with said manually operable means.

12. A device according to claim 11, wherein the size of the aperture in said frontal face is relatively small compared to the size of the chamber, and said means on said cam member for cooperatively engaging with said manually operable means extends only a short distance from said cam member, whereby the space surrounding said cam member means is substantial so that the introduction of a tampering tool through the small-sized aperture will find no fulcrum support on the chamber walls.

13. A device according to claim 11, wherein said lock body, said cam member, said lock plates and said biasing member, when assembled, define a subassembly, said housing having at one end a large opening for receiving said subassembly, and means for securing said subassembly within said housing.

14. A locking device for use with an electrical plug having two or more prongs, comprising a housing and a lock mechanism disposed in said housing, said lock mechanism including a prong locking mechanism, prong locking members movable translationally from an unlocking position to a locking position to lockingly engage at least two of said prongs when said plug is inserted into the housing, said prong locking mechanism being integrally associated with said prong locking members for normally biasing said prong locking members into said locking position, and manually operable means for moving said prong locking members to said unlocking position to obtain the release of said inserted plug, wherein said housing includes front and rear walls, said housing having an internal structure defining a pair of spaced walls extending between said front and rear walls and defining a slotted bed and a pair of opposed elongated slots, an aperture in said front wall for receiving said manually operable means, a cam member provided with an internal camming slot and rotatably supported in said slotted bed, said prong locking mechanism supporting a pair of cam fingers extending along a longitudinal axis of said prong locking mechanism and engaging said internal camming slot, said prong locking mechanism having a configuration for resiliently maintaining said prong locking members in an outwardly extended locking position, whereby said prong locking mechanism defines a subassembly which is insertable into said housing.

15. The device according to claim 14, wherein said housing is provided at one end with two or more apertures adapted to accept said two or more prongs, said one end of the housing being provided with means to partially enshroud said plug, whereby the portion of the prongs emerging from said plug is concealed to prevent tampering.

16. The device according to claim 14, said cam member being provided with engageable means disposed opposite to said internal camming slot, said manually operable means being in the form of a key having a free end adapted to engage said engageable means so that torque can be applied to rotate said cam member to apply a force to overcome the bias existing between the prong locking members to thereby release said plug prongs.

17. The device according to claim 14, wherein said housing is provided with a defined aperture adjoining said slotted bed, the aperture adapted to receive and house engageable means on said cam member, an enlarged chamber adjoining said aperture, said chamber being substantially larger than said aperture in the front wall, whereby the constricted side of the front wall aperture and the large chamber discourage tampering with the locking device.

18. A locking device for use with an electrical plug having at least two prongs, comprising a housing having a pair of mated sections provided with internally arranged slots and a cavity, and a prong locking mechanism disposed in said housing, said slots defining a pair of prong receiving slots and said cavity being adapted to receive said prong locking mechanism, said prong locking mechanism comprising a bifurcated member supporting a pair of biased prong locking projections extending outwardly along a transverse axis of said member and extending into said prong receiving slots, said member further supporting a pair of longitudinally extending cam fingers, a cam member, said cam fingers operatively engaged by said cam member, and manually operable means for actuating said cam member, whereby said cam member is effective to withdraw said prong locking projections from said prong receiving slots to release the plug prongs.

19. A device according to claim 18, wherein said mated sections define a small aperture in a front wall, a large internal chamber adjoining said front wall adjacent said aperture, and engageable means on said cam member for cooperatively engaging with said manually operable means, said engageable means on said cam member extending into a narrow opening in an internal wall on the other side of said large chamber, whereby the large internal chamber provides a substantial space so that the introduction of a tapering tool through the small-sized aperture in the front wall will find no fulcrum support on the chamber walls.

20. A device according to claim 18, wherein each housing section has a pair of spaced-apart walls, each wall having a slot, said slots in said walls, when said sections are mated, defining a pair of apertures, said prong locking mechanism and said cam member, when assembled, define a subassembly, said housing having, at one end, a large chamber for receiving said subassembly, said prong locking mechanism being operatively supported in said chamber by the engagement of said prong locking projections with said apertures.

21. A locking device for use with an electrical plug having two or more prongs, comprising a housing, a lock mechanism disposed within said housing, means for securing said lock mechanism in said housing, locking members movable translationally from an unlocking position to a locking position to lockingly engage at least two of said prongs when said plug is inserted into the housing, spring means for normally biasing said locking members into said locking position, manually operable means for moving said locking members to said unlocking position to obtain the release of said inserted plug, said lock mechanism in said housing comprising a lock body housing defining a pair of spaced walls joined by a face wall and defining a slotted bed and a pair of opposed elongated slots, an aperture in said face wall for receiving said manually operable means, a cam member provided with an internal camming slot and rotatably supported in said slotted bed, a pair of lock plates disposed between said spaced walls, said lock plates having a pair of cam fingers engaging said internal camming slot and having a structure defining said locking members, said locking members insertably supporting said lock plates in said elongated slots, said spring means being a spring interposed between said lock plates to urge them and their associated locking members into the locking position, whereby said lock mechanism, when assembled, defines a subassembly which is insertable into said housing.

22. The device according to claim 21, said housing comprising an integrally molded structure having one end provided with two or more apertures for accepting the prongs of said plug and the other end having an entrance communicating with the interior of the housing, said lock mechanism having unidirectional securing members adapted to engage with said housing to secure said lock mechanism in the housing, whereby said subassembly is forcefully introduced through said entrance into the housing, said unidirectional securing members facilitating the entry of the subassembly into said housing but preventing the withdrawal of said subassembly from said housing.

23. The device according to claim 22, wherein the interior of said housing, at said one end of the housing, adjacent said prong apertures, is provided with an integrally molded support block forming a part of said securing means, and said unidirectional securing members forming the other part of said securing means.

24. The device according to claim 21, said cam member being operatively supported by said lock body housing and being provided with an engageable member disposed opposite to said internal camming slot, said manually operable means being in the form of a key having a free end adapted to engage said engageable member so that torque can be applied to rotate said cam member to apply a force to overcome the bias of said spring to thereby release said plug prongs.

25. The device according to claim 24, wherein said lock body housing is provided with an enlarged chamber adjoining said slotted bed, said chamber receiving said engageable member, said chamber being substantially larger than said aperture in the face wall, whereby the constructed size of the face wall aperture and the large chamber discourage tampering with the locking device.

26. The device according to claim 21, wherein said housing and said lock mechanism is made from electrically non-conductive materials.

* * * * *